US006409633B1

(12) United States Patent
Abelbeck

(10) Patent No.: US 6,409,633 B1
(45) Date of Patent: Jun. 25, 2002

(54) MOVING SURFACE EXERCISE DEVICE

(76) Inventor: Kevin G. Abelbeck, 1220 Venice Blvd., #205, Venice, CA (US) 90291

( * ) Notice: Subject to any disclaimer, the term of this patent is extended or adjusted under 35 U.S.C. 154(b) by 0 days.

(21) Appl. No.: 09/534,139

(22) Filed: Mar. 23, 2000

Related U.S. Application Data

(62) Division of application No. 09/087,651, filed on May 30, 1998, now Pat. No. 6,042,514.

(51) Int. Cl.[7] ..... A63B 22/00
(52) U.S. Cl. ..... 482/54; 482/51
(58) Field of Search ..... 482/51, 54; 198/434, 198/437, 439; 193/37

(56) References Cited

U.S. PATENT DOCUMENTS 3,713,521 A * 1/1973 Moritake ..... 193/37
3,731,782 A * 5/1973 Del Rosso ..... 198/439

* cited by examiner

*Primary Examiner*—Glenn E. Richmon

(57) ABSTRACT

A novel moveable surface conveyor system, especially used as an exercise treadmill is disclosed. The surface is comprised of a plurality of deck members, each pivotally attached to the adjacent deck member, thus creating a continuous loop with an upper run and a lower run. At least the upper run of the loop is supported on a pair of side frames by a support means which is comprised of a series of wheels or bearings. Annular configurations of the support means exist at one or both ends of the treadmill to facilitate the transition of the deck members from the upper run to the lower run and back to the upper run. These configurations include a race that receives the bearings, the bearings being attached to the deck members or the bearings can be mounted on the side frames. Here the bearings receive and thereby support and guide the deck members, thus eliminating the traditional drum pulleys which are prevalent in the art. The deck members are driven, or braked, by a mechanical communication with a star sprocket which is driven by a rotary motor or actuator or in the preferred embodiment, the deck members are driven, or braked, by coils (primary members) and the deck members are the secondary members of what would be considered a linear motor. This system directly drives the continuous loop without the belts, pulleys and separate motors found in the art. The invention reduces the complexity, cost, wear and breakdown potential of current devices.

14 Claims, 9 Drawing Sheets

MOVING SURFACE EXERCISE DEVICE

This application is a division of Ser. No. 09/087,651, filed May 30, 1998, now Pat. No. 6,042,514.

BACKGROUND OF THE INVENTION

1. Field of the Invention

The invention herein relates to an exercise device and more particularly to a treadmill commonly used for physical exercise and training.

2. Overview of Prior Art

The treadmill for use as a physical exercise device has evolved from the use of conveyors in industry. These systems are used to transport items from one place to another and are typically comprised of an endless belt that travels over front and rear pulleys, one of which is mechanically connected to a drive system such as an electric motor. Since the belt must be pliable to bend around the pulleys the space between the pulleys must be supported because the pliable belt would likely not be able to support the weight of the objects being transported thereon. As a solution what is commonly used is a plurality of rollers with their axes oriented parallel to the end pulleys. The rollers are free to support the weight of the object adding only a minimal amount of friction to the system.

Exercise treadmills necessitate supporting loads in excess of 2½ to 3 times the users body weight (Cavanagh and Lafortune) and (Nilsson and Thorstensson). The maximum foot contact with the running surface during running is around 54% (Kaliszer, et al) and given an estimate of 35 sq. in. of surface area of a runner's foot the resultant pressure is over 31 psi (214 KPa) for a 200 pound runner on a flat surface. If a runner is forced to run on a set of rollers this pressure could increase by 5 times or more. Though this load produces a pressure that is slightly less than 1% of the yield stress of bone (121 MPa) (Skalak and Chien), the stretch receptors in the skin detect discomfort. This pressure used in a in vivo model for compression response of skin (Dikstein and Hartzshtark) results in a deformation of 133 meters. Clearly far beyond the 2–4% seen in the linear region of stress-strain response of skin. The resultant helps to explain why we see potential for long term injury due to even seemingly small changes in running mechanics. Changes in how the runner's foot strikes or leaves the surface may cause problems (Chadbourne). Trying to run on a set of rollers could greatly alter running gait due to the body's response to the increased foot pressure.

The industry has adapted a minimally functional model for people to run on that has remained virtually unchanged for several decades. Traditional samples are seen in U.S. Pat. No. 5,542,892 to Buhler where a belt (14) is supported by a pad (46) which is supported by a flat and substantially rigid deck (48). The belt is an endless belt which is kept in tension by a front and rear drum pulley. A motor drives a pulley and the friction between the underside of the belt and the surface of the pulley allows the belt to move across the surface of the deck, which is the running surface. The pad assists in absorbing the impact of the user's foot on the running surface.

The obvious problem is the friction between the belt and the deck or pad. As previously calculated, a great deal of pressure is generated between these surfaces. Not only does this predispose the belt to wear but the system must maintain enough kinetic energy to pull the user's foot over the deck without it slowing. This would generate a "cogging" effect and greatly disrupt the user's running gait. The Buhler patent disclosure includes a antifriction or wax block (49) to try to reduce the coefficient of friction between these surfaces. The dichotomy is that the system requires a good deal of friction between the belt and the pulley but necessitates minimal friction between the belt and the deck.

A similar disclosure is made by Skowronski et al in U.S. Pat. No. 5,599,259. Here a rear front belt pulley (22) and a rear belt pulley (28) are chambered to assist in the tracking of the belt (20). The belt is supported by the deck (50) with additional structures to give the deck flex to help absorb the impact of running. The drive transmission (111) and motor (104) is shown to drive the rear pulley (28) in the large unit and the front pulley in the small unit.

This is one of the few disclosures that identify the advantage of rear pulley drive as it is associated with this type of device. Since the belt is pliable it can only transmit load effectively in tension not in compression, thus fewer fibers are stressed due to the tension requirement to pull the runner's foot caused by the friction between the belt and the deck when the rear pulley drives the belt rather than the front pulley. This is because the rear pulley is closer to the application of the load and therefore the frictional force. Smaller units cannot fit the motor between the upper and lower runs of the belt so the motor is placed in the front and the front pulley drives the belt.

Methods to overcome this friction problem have been addressed by several individuals. One such attempt is made by Schonenberger in U.S. Pat. No. 4,334,676 and also in U.S. Pat. No. 4,614,337. Here a movable surface treadmill is disclosed where the surface is comprised of a plurality of step or slat elements that are attached to an endless belt, the belt being driven by one of the front or rear pulleys. The slat elements are supported on the upper run by a series of support rollers that are supported by the frame of the unit. This creates an upper run that includes only rolling friction of the slats on the support rollers and not sliding friction between a belt and a deck.

The conception and application works well except other than the complexity of the device. The resultant is comprised of much of the existing components of a traditional treadmill while adding a combination of slats that are connected to the belt and an array of support rollers on each side of the slat members. The combination is a device that is not price competitive in the market place.

A specialty device is disclosed by Lepine et al., in U.S. Pat. No. 5,385,520, in the form of an ice skating treadmill. This device is similar to the previously disclosed in that it is comprised of a front and rear pulley which supports an endless belt, only the belt is covered with ridged plastic slats. The reinforced belt is supported on each side of the upper run by a set of roller supports. The combination does eliminate the sliding friction associated with a traditional treadmill, as does the previous disclosure but here as before the physical size is prohibitive to many applications, even if it was modified to be used for an individual on which to run. In addition, the traditional problems associated with belt tracking on the drum pulleys, the weight and cost of such a device would make it prohibitive.

A horse exerciser is disclosed by Pike in U.S. Pat. No. 4,361,115. This has parallels to the previously disclosed in that individual slats are secured to links of two parallel roller chains instead of a continuous belt. The front and rear drum pulleys are replaced by two pair of sprockets which guide and/or drive the combination. The upper run of the plurality of slats are supported by an arrangement of roller supports positioned along the sides of the upper run, as previously done. Tracking of the segmented belt is now extremely critical. If one side of the one bearing support which supports the sprocket combination drifts a slight amount the associated sprocket will not align with the chain links and jump the track. This not only would result in ceasing the operation of the device while in use, which could result in injury to the user, but as the motor continues to attempt to drive the unit, damage to the device would likely result. Since roller chain commonly stretches with normal use due to the wear on the pivoting components, and no idler function is employed the likelihood is great.

If the device was scaled down for human use this problem would be even more likely because as the sprocket size is decreased the size of the roller chain, the tooth depth also decreases, thus increasing the risk of disengagement. Also the labor intensive cost associated with securing a slat to each roller chain link would make such a device very expensive and not practical in the marketplace.

Another animal treadmill is disclosed by Rhodes in U.S. Pat. No. 5,277,150 which is specified for use by dogs. The treadmill portion of the device is similar to the previously disclosed in that it is comprised of a pair of end rollers disposed at either end of the supportive surface. parallel planks are fastened to a pair of belt member called runners. The runners articulate with a plurality of support roller bearings in the span between the end rollers. There is no apparent disclosure of a resistance or power means to drive or slow the movement of the treadway relative to the dog. This lack of resistance or power would make this device virtually non-functional for human use.

An alternative to the roller chain of the earlier referenced is disclosed by Schonenberger in U.S. Pat. No. 5,470,293. As with all belt or chain track devices which are driven by one of two drum pulleys (or sprockets), the inability of the track and the pulley to slip is important for this is what drives the running surface. Here the inventor discloses drum or deflection pulleys which includes a sliding disk member and a toothed-disk member. The sliding disk member includes a V-belt area to assist in the transmission of force to drive the belt. The use of the V-belt reduces the noise as compared to the toothed belt, thus the combination allows a smaller toothed belt and even an intermittent toothed disk. The tracking advantages of the toothed arrangement and the quiet of the V-belt still speak to the inherent problems of drum pulleys to drive a belt, even if the belt is has a laminate of structure elements to eliminate the need for a treadmill deck.

Another moving supportive surface is disclosed by Lee et al in U.S. Pat. No. 4,938,473 in that of a treadmill with a trampoline surface. Here an endless trampoline surface is supported on the sides by roller brackets which run on support rail on each side of the endless belt including curved portions on the front and rear of the device. Springs connect the brackets to the endless belt, the combination generating a spring like running surface. Another version is disclosed in which a pair of end rollers is used to support the endless belt on the front and rear of the treadmill. In this case a drive means is mentioned in the text as being powered to rotate the belt, but specifics are not described beyond that. In the version which includes a curved rail portion on the ends shows a hidden end pulley in FIG. 4, but no apparent reference beyond that. In this case, no drive means is disclosed nor anticipated by this disclosure due to the absence of the end pulleys which drive the belt.

A cushioned surface such as this is prone to excessive deflection of the running surface resulting in an unstable running surface. This predisposes the runner to potential excessive inversion and eversion of the subtalar joints in the feet of the runner. Since the center of rotation of the subtalar joint is above (superior) to the bottom of the foot, where contact is made with the running surface, and loading comes from above, through the ankle this joint, this places the joint in unstable equilibrium, thus predisposing this and other joints of the lower body to excessive rotation and potential damage. This is supported by the findings of Chadbourne which cites the occurrence of acute injuries from running on soft surfaces.

The Lee et al patent does disclose a method of reducing the vertical displacement of the foot on the running surface by the placement of a "deck" under the belt. The upper surface of the deck is disclosed in FIG. 10 to be comprised of "an upper frictionless surface 72, a middle cushioning surface of foam, for example, 73, and a lower structural surface of metal, wood or the like, designated by the numeral 74". This is unreasonable because first of all a "frictionless" upper surface does not exist. The resultant combination would functionally be no different than that of Buhler or Skowronski et al which were previously disclosed and the limitations cited are apparent here as well here.

SUMMARY OF THE INVENTION

The object of the disclosed invention is to provide a movable surface conveyor system, especially used for physical exercise, that eliminates the sliding friction between the deck and belt of a traditional treadmill while providing the efficiency which allows such a device to be produced in a price competitive fashion with respect to traditionally made treadmills. One of the methods of reducing the cost of the device is to provide a means of guiding and driving the running surface of the invention without the use of a drum pulley and belt arrangement. The disclosed invention includes a plurality of individual deck members that are pivotally joined one to another to form an loop with an endless surface, including an upper run. The individuals members of at least the upper run are supported by a series of support members which are traditionally ball bearings. These bearings can be mounted to the frame, being received by the deck members as they traverse path of the upper run, or they may be mounted to the deck members, the bearings being received by a track formed in the frame of the invention.

The invention also includes the deck members being components of a linear motor. The rotor (secondary member) being part of some or all of the deck members and the stator (primary member) being secured to the frame of the invention. Typically this would suggest that a series of permanent magnets be oriented on the deck members and one or more current-carrying coils being stationary to the frame. The coils producing an electromagnetic field to directly drive the deck members. This combination can include contacts to control the phasing of the coils but more than likely an encoder or proximity sensor such as an ultrasonic, inductive or capacitive sensor is used to detect the position of one or more of the deck members (rotors or secondary members) with respect to the coils (stators or primary members) and appropriately energizing the coils as necessary.

The method of driving and controlling the deck members are not specific to the invention. The type of motor, whether it be an induction, synchronous, reluctance, commutator, hysteresis or any other type is not relative to the novelty of the invention. The invention as disclosed has now only one moving part, thus reducing the manufacturing cost, breakdown potential, wear and assembly cost and no sliding friction between the deck and the belt because it has neither a stationary deck or a belt.

An alternative design is disclosed which also utilizes the individual deck members that are pivotally connected to form an endless track. The endless track being supported by bearings on the side of the frame, at least in the area of the upper run. The invention includes a rotary drive sprocket at the rear of the upper run which articulates directly with the individual deck members, thereby driving same. The lower run hangs free and is received by bearings positioned in an arcuate manner or an arcuate track at the front of the frame thus being capable of receiving the bearings of the deck members. The arcuate portion displaces the deck members to position them so as to create the upper run. This combination, as before, eliminates the drum pulleys and here uses only a drive sprocket, which is driven by a rotary power means such as a rotary motor. The elimination of parts results in reducing the cost of the invention over the prior art.

DETAILED DESCRIPTION OF THE PREFERRED EMBODIMENT

In response to the current inadequacies of products in the marketplace, the following disclosure is made thus showing and describing a novel improvement relative to the current state of the art. What is herein disclosed is a movable surface conveyor system, especially for use in the area of physical exercise, wherein all versions of the invention do not use a belt, deck nor drum pulleys to drive the belt. The inventor is not aware of any such combination in the industry, and therefore the preferred embodiment includes several alternative designs, though each has the elegance associated with the removal of the traditional parts as previously listed.

Figure 1:
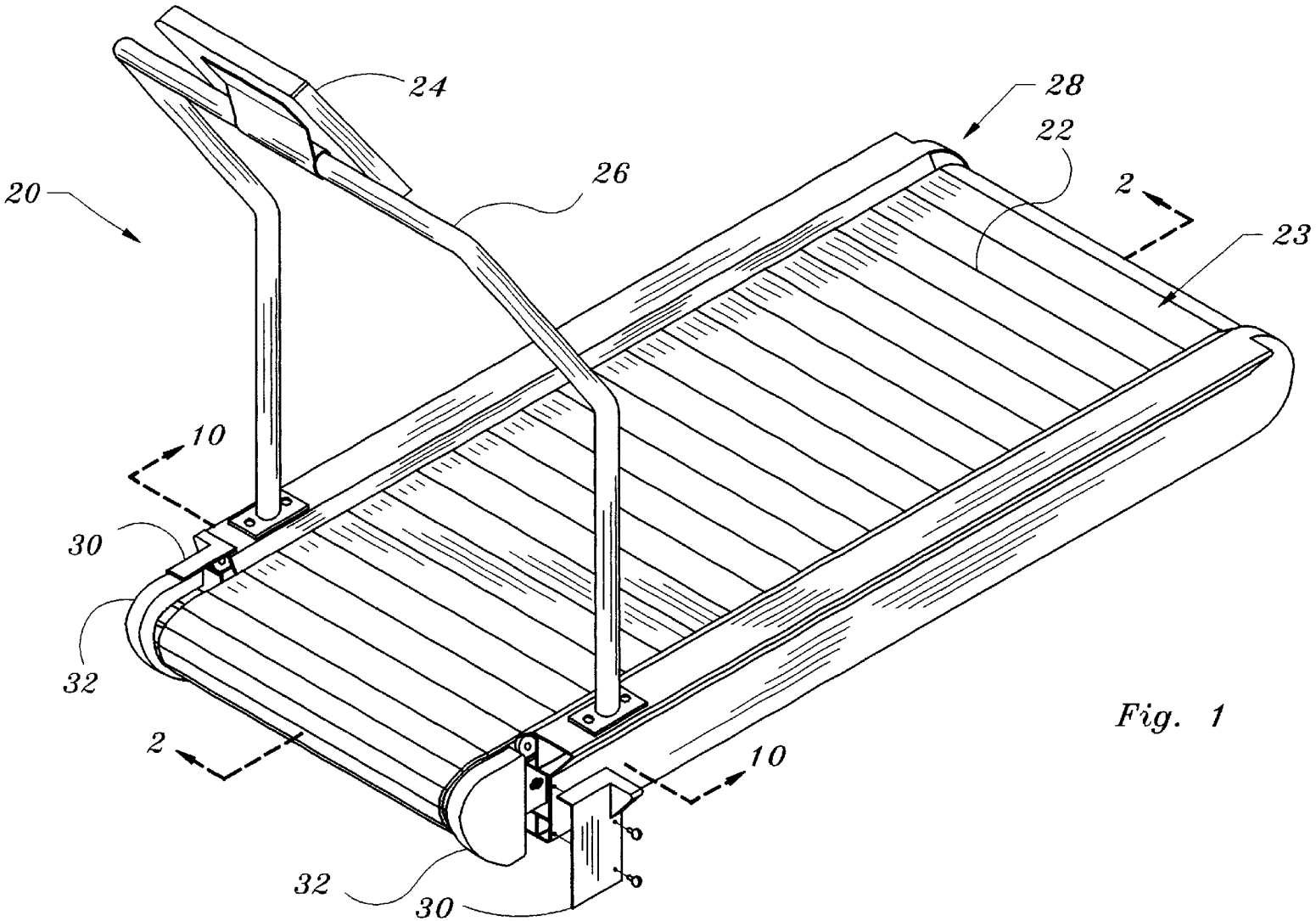
FIG. 1 is a isometric view of a moveable surface exercise device shown with the adjustment panel removed, the device produced in accordance with the preferred embodiment of the present invention.

Referring to the drawings, FIG. 1 shows an isometric view of the preferred embodiment of the invention as it would be used as a treadmill 20. The treadmill deck is comprised of a plurality of individual deck members 22 together making a continuous segmented track 23 which is used as the running surface of the treadmill. As with traditional treadmills, the preferred embodiment includes a display 24 supported by handle frame 26. The handle frame 26 is likely constructed of a hollow metal tube thus enabling interaction of the user to the machine and electrical communication of the display 24 to the drive and sensing mechanisms in the treadmill base 28. The access panel 30 on the near side is shown removed as would enable tension adjustments to be made to the segmented track 23 by movement of the adjustment end cap 32. This is detailed later in the disclosure.

Figure 2:
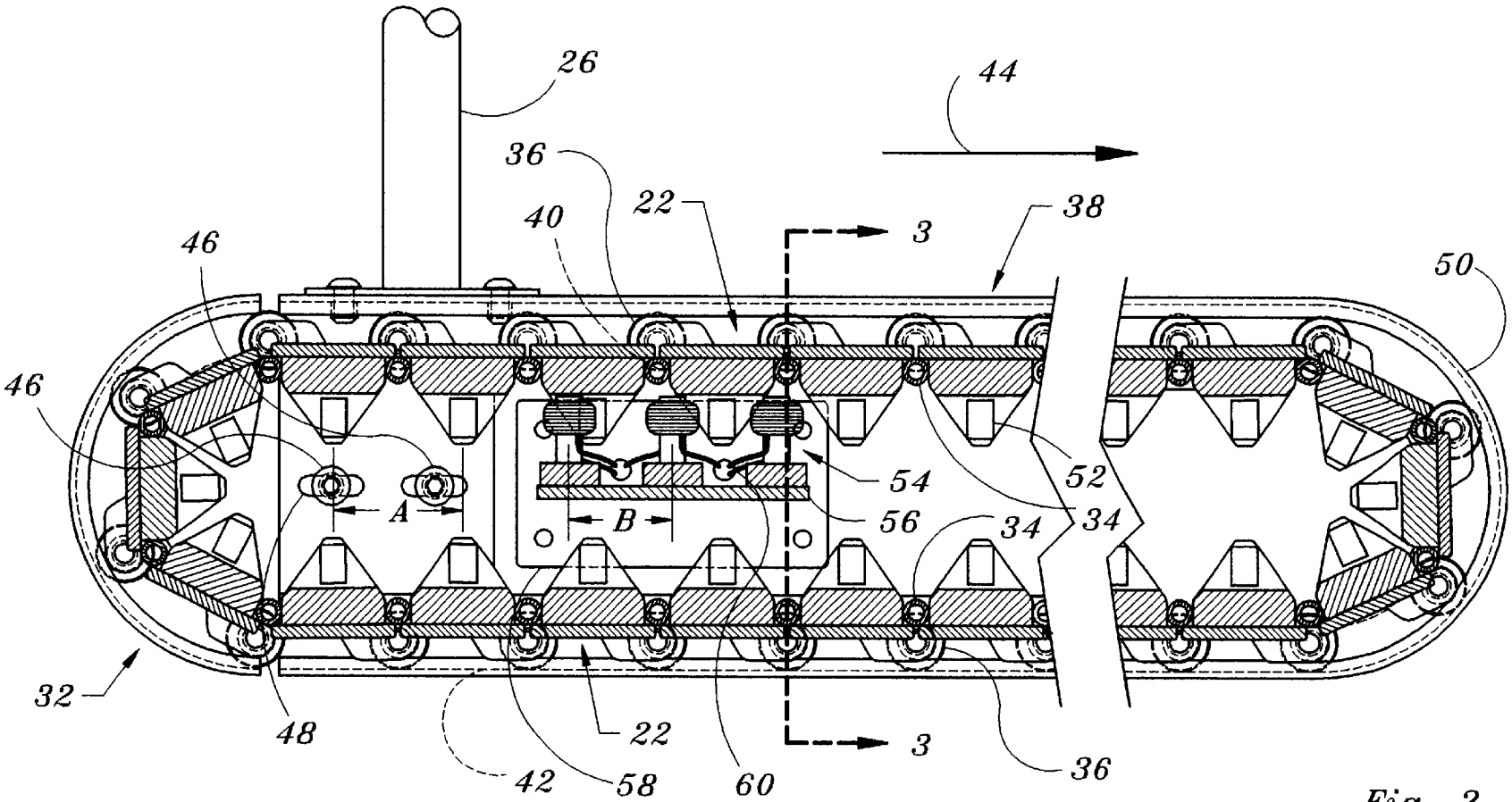
FIG. 2 is a partial front sectioned view along the line 2—2 shown in FIG. 1 of the internal base portion of a moveable surface exercise device produced in accordance with the preferred embodiment of the present invention.

A sectioned view along line 2—2 is shown in FIG. 2. The bottom portion of the handle frame 26 identifies the front of the treadmill. In this embodiment, the deck members 22 are shown in greater detail in that they are pivotally mounted one to another by pivot tubes 34. Each deck member 22 is supported by a support member 36 which is here shown to be a wheel or ball bearing. The support members 36 are supported by the side frame 38 which includes an upper race 40 and a lower race 42 on which the support members 36 travel. This enables an upper run and a lower run respectively. The upper run is the running surface of the treadmill and would traverse in the direction of the arrow 44. Because the deck members 22 are supported on the frame by the support members 36, which preferably are ball bearings, no belt is used to slide over a deck, thus the only sliding friction is the minimal amount from the pivot tubes 34 of adjacent deck members 22. This vast reduction in frictional force enables greater loads to be handled by the running surface with minimal wear over time.

Traditional treadmills use front and rear drum pulleys to drive the belt. Other than the references cited, this is usually done by the friction between the pulleys and the belt. This necessitates an adjustment in position of the pulleys to allow assembly and allow for variations in the length of the endless belt. This problem is not so apparent in that no drum pulleys are used in this invention. It is though desirable for excessive slack to be removed from the continuous segmented track 23. This is accomplished by the adjustment end cap 32 which is adjustable in length by slidably varying its position on the side frame 38 and securing it in place with fasteners 46 through slots 48. The rear arcuate portion 50 of the side frame 38 can be a rigid communication between the upper race 40 and the lower race 42.

Another novel feature of this embodiment is the drive means. Here a linear synchronous motor is portrayed in which the permanent magnets 52 are mounted to the deck members 22 and the coils 54 generate the electromagnetic field to drive the permanent magnets 52. What is shown here in FIG. 2 is only one example of a wide variety of possibilities that would each have advantages in specific situations. Here the coils 54 are mounted to a cross brace 56, which is in turn secured to an end plate 58. The end plate 58 on each side of the cross brace 56 allows one side frame 38 to be fastened to an opposing side frame to create a functional treadmill base 28. The coils are shown here to be contained in pods of three coils. The number of coils 54 is not contingent upon the novelty of the invention, nor is the number of pods used within a unit critical to the disclosure. A sequence of energizing the coils 54 creates a moving magnetic field that drives the deck members 22, utilizing the field of the permanent magnets 52. A variation is shown here in which the pitch of the permanent magnets 52 (A) is different than that of the coils 54 (B). This is done as one method of ensuring that at least one coil in each pod is in a position to effect a deck member 22 when the system starts from a stopped condition. This also is not integral to the novelty of the invention, and is only one method of ensuring proper start up. Electrical communication to the coils 54 is provided by wires 60 that are routed through the end plate 58 and into the side frame 38.

Figure 3:
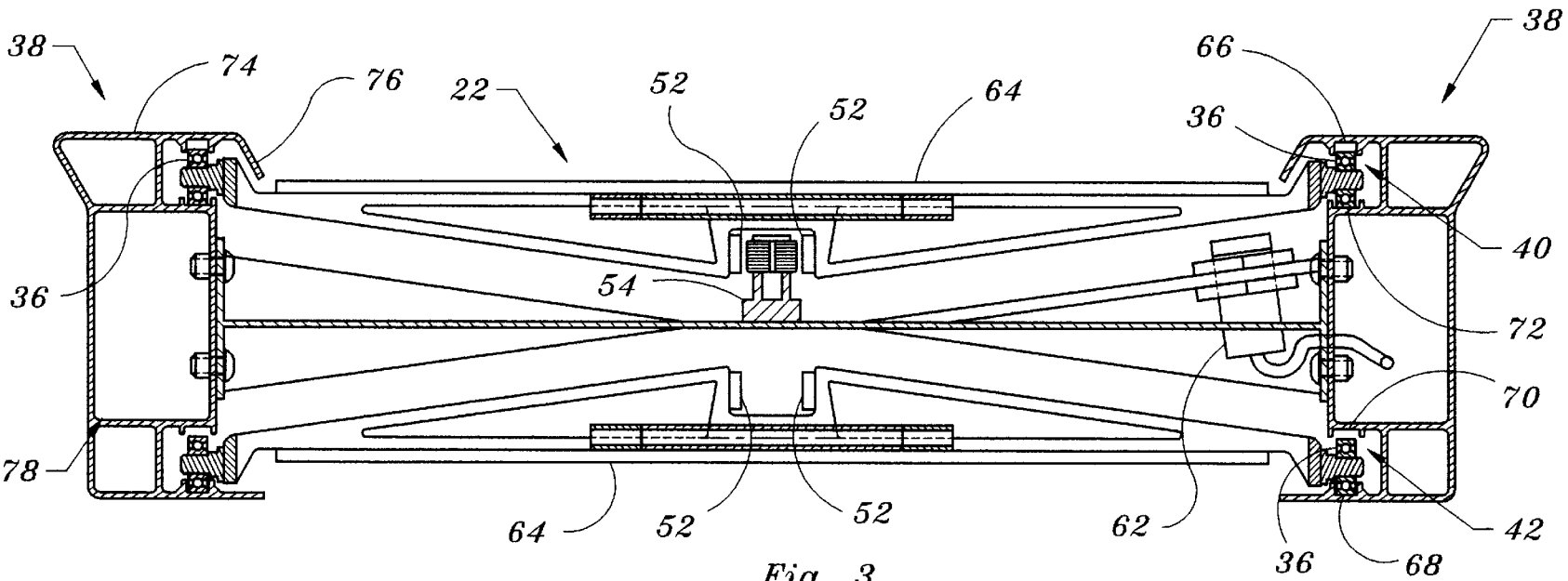
FIG. 3 is a side sectioned view along the line 3—3 shown in FIG. 2, only showing the full side view not just the section of FIG. 2 of a moveable surface exercise device produced in accordance with the preferred embodiment of the present invention.

A full section along line 3—3 is shown in FIG. 3, with the addition of both side frames 38, showing a single deck member 22 of the upper and lower run. In this view the proximity of the magnets 52 can be seen relative to the coil 54. This is only one of the many possible arrangements A proximity sensor 62 is shown here to sense the position of the deck members and associated magnets 52 to relay information to the controller (not shown) which controls which coils 54 are energized at what time. The type of proximity sensor used is not important and many could be used in a linear motor application. These include optical encoders, inductive magnet sensors, capacitive sensors and ultrasonic sensors to name some possibilities.

The deck member 22 is likely made of a material that is reasonably light weight and very durable. The deck member 22 can be designed to flex upon impact with the user's foot to thereby absorb the impact of the user's foot, creating a cushioned deck, or it can be made rigid and used with a cushion 64 as shown here. The cushion 64 absorbs some of the energy imparted by the impulse of the user's foot on the running surface. The side frames are also shown as one example of an infinite number of functional variations. In this version the support members (bearings) 36 are rotateably mounted to the deck members 22, whereby the side frames 38 clearly show the upper race 40 and the lower race 42.

The support members 36 are captured so as to prevent them from "jumping the track". Therefore the upper and lower races have a top and bottom. Because of the annular ends of the side frames 38 the upper side 66 of the upper race 40 is continuous with the bottom side 68 of the lower race 42. Likewise, the top side 70 of the lower race 42 is continuous with the bottom side 72 of the upper race 40. The side frames 38 utilize a platform 74 for the user to step on and a guard 76 to prevent accidental contact with the support members 36. The hollow cavity 78 allows for wire harnesses and the like so that there is no danger of becoming tangled with the deck members 22 nor damaged by contact with the support members 36.

Figure 4:
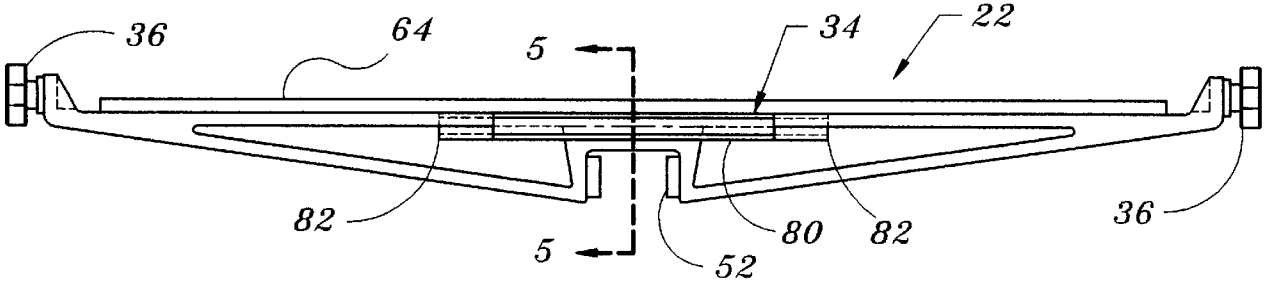
FIG. 4 is a front view of a single deck member of a moveable surface exercise device produced in accordance with the preferred embodiment of the present invention.

A single deck member 22 is shown in FIG. 4 with the support members 36 one on each end, the permanent magnets 52 on the bottom side, cushion 64 on the top side and pivot tubes 34 mounted to their respective sides. The pivot tubes 34 are further comprised of a front tube 80 and two rear tubes 82. To assemble, a rod (not shown) would be inserted through the rear tubes 82 of one deck member with the front tube 80 of an adjacent deck member there between, thus pivotally connecting one to another. This would be continued until the first and last deck members were like connected thus creating a continuous segmented track. The rod would be secured to one or both of the smaller rear tubes 82 and a ball bearing or a suitable bearing material would be used in the front tube 82 between the rod and the front tube 82. This would minimize wear and therefore the "stretch" of the segmented track after use.

Figure 5:
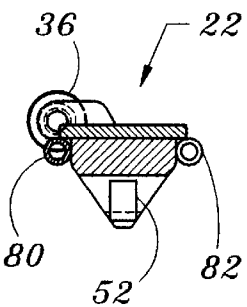
FIG. 5 is a side sectioned view along line 5—5 of the deck member shown in FIG. 4 of a moveable surface exercise device produced in accordance with the preferred embodiment of the present invention.

A sectioned side view of a deck member 22 along line 5—5 is shown in FIG. 5. This again shows the magnet 52 located on the bottom of the deck member 22 and the cushion 64 on top. The positions of the rear tube 82 and especially the front tube 80 is important relative to the support member 36. As the support member 36 rolls along the upper race 40 of the side frame 38 and the center of rotation of that support member 36 is the point of contact of the support member 36 and the bottom side 72 of the upper race 40 (the flat surfacce). The center of rotation of one deck member 22 to the adjacent deck member 22 is the center of the front tube 80 (and adjacent deck member's rear tubes). On a flat surface, the centers of rotation align, thus the deck members do not have a tendency to "wobble" under loading because there is no moment applied, because the moment arm has no value.

As the combination passes through the annular end runs this alignment is slightly displaced, depending upon the radius of the curve. In any case, the deflection is minimal and minor changes in orientation of the support member 36 relative to the front tube 80 could result in even smaller deformation through the change in direction and yet maintain in a stable orientation during loading of the upper run. Thus, minor misalignment of the support member 36 and the front tube 80 may be desirable in some situations, but the basic design remains.

Figure 6:
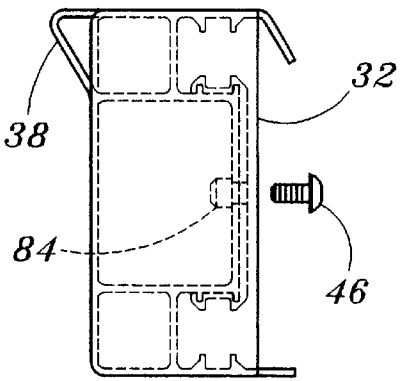
FIG. 6 is a side view of a single side rail with an adjustment end cap of a moveable surface exercise device produced in accordance with the preferred embodiment of the present invention.

The method of enabling transition from upper run to lower run and again to upper run is an important part of the invention because no drum pulleys are used in the invention. FIG. 6 shows a side view of the adjustment end cap 32 mounted on a side frame 38, shown without the continuous segmented track. Threaded inserts 84 are used to accept the fastener 46 that in turn secures the adjustable end cap 32 to the side frame 38.

Figure 7:
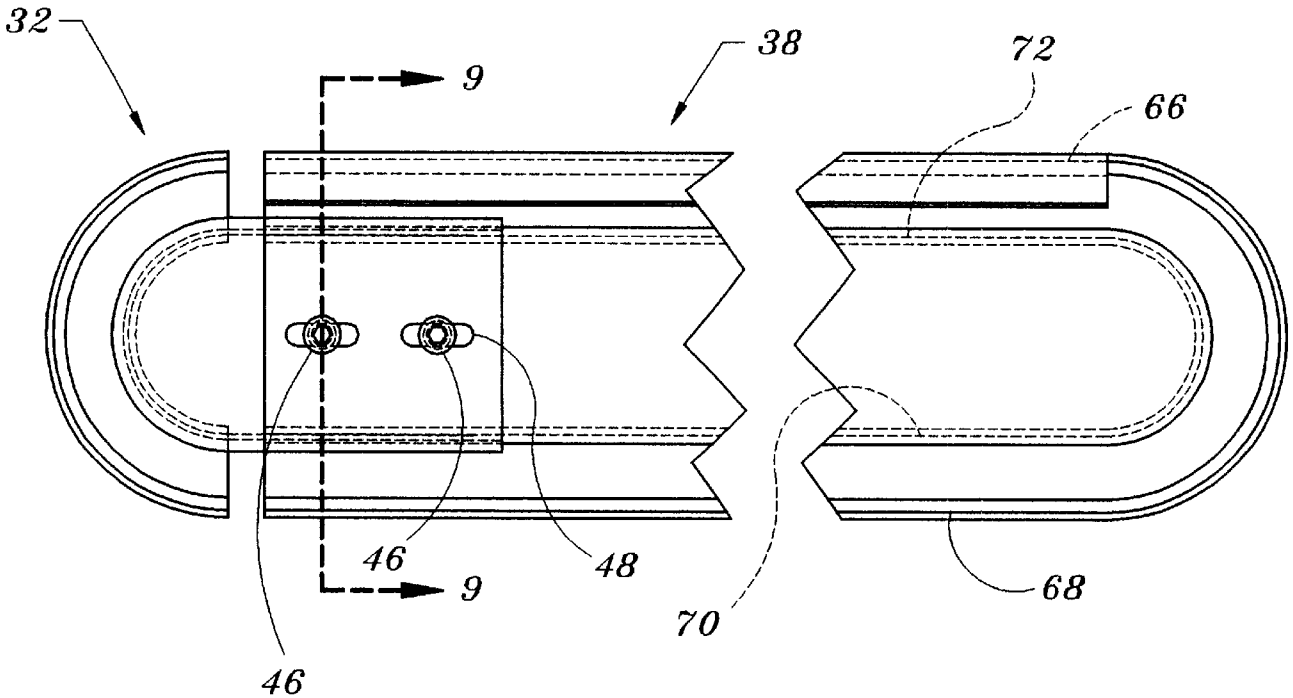
FIG. 7 is a partial front view of the side rail shown in FIG. 6 of a moveable surface exercise device produced in accordance with the preferred embodiment of the present invention.

A front view of this assembly is shown in FIG. 7. Here the fasteners 46 are shown to pass through the slots 48 in the adjustable end cap 32 with the threaded inserts being secured to the side frame 38. Horizontal movement of the adjustable end cap 32 allows slop to be taken out of the continuous segmented track when it is assembled into the side frames 38. The side frame also reveals the top side 66 and bottom side 72 of the upper race and the top side 70 and the bottom side 68 of the lower race.

Figure 8:
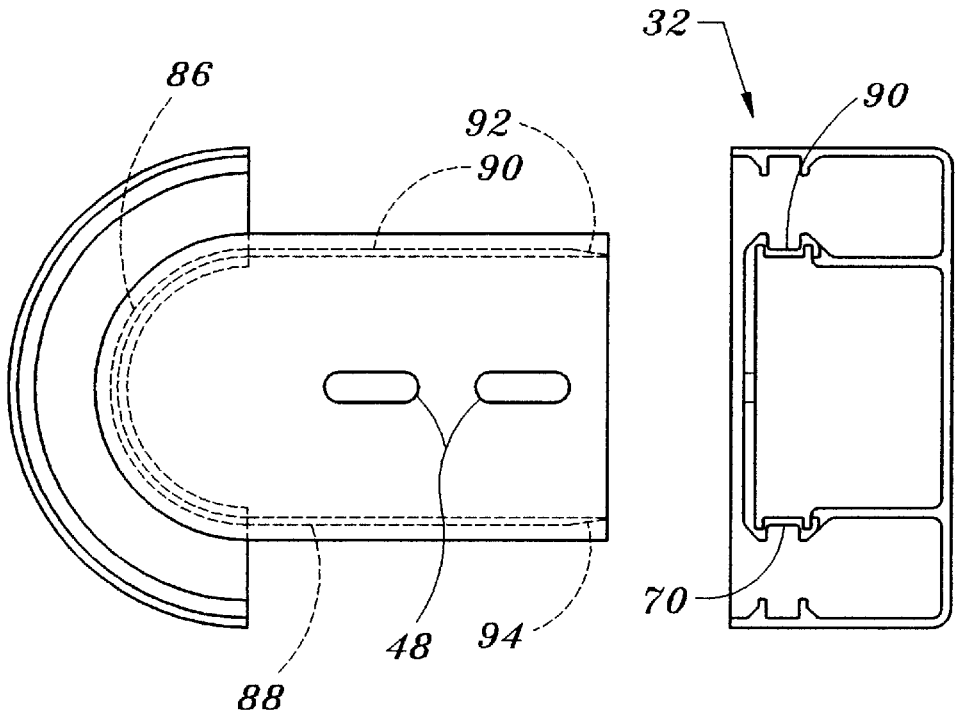
FIG. 8 is a side and front view of an adjustment end cap of a moveable surface exercise device produced in accordance with the preferred embodiment of the present invention.

The adjustable end cap 32 is shown in more detail in FIG. 8. The front view shows the slots 48 that receive the fasteners 46 and allow the lateral movement of the cap 32. The annular portion of the cap 32, including the inside race 86 which connects the cap bottom upper 88 to the cap top lower race 90, is also shown. The transition from the cap 32 to the side frame 38 is made by the upper cap ramp 92. The race of the cap 32 fits over the races of the side frame 38. Since this is the front of the treadmill, the support members will be rolling on the cap top lower race 90 down the ramp 92 and onto the bottom side 72 of the upper race 40 of the side frame 38. On the lower race 42 of the side frame 38 the support members 36 articulate with the bottom side 68 of the lower race 42 and only transition to the bottom side 72 of the upper race 40 through the annular portion or the inside race 86 of the cap 32. Thus the lower ramp 94 will not contact the passing support members 36, but if under some condition they would contact, a ramped transition is provided to eliminate any "bump" of the deck members 22.

Figure 9:
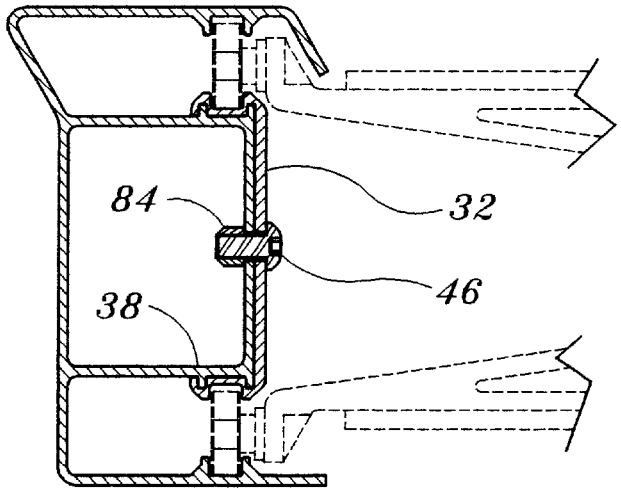
FIG. 9 is a side sectioned view along line 9—9 as shown in FIG. 7 of a side rail and adjustment end cap with a partial view of two deck members shown for reference, the device produced in accordance with the preferred embodiment of the present invention.

To further illustrate the assembly of the design, the assembled combination is shown in FIG. 9 in a section view along line 9—9. Here it is easily seen the fastener 46 securing the adjustable end cap 32 to the side frame 38 by use of the threaded insert 84 secured to the side frame 38. The races of the adjustable end cap 32 fit over the races of the side frame 38. A partial view of an upper run and a lower run are shown for reference.

Figure 10:
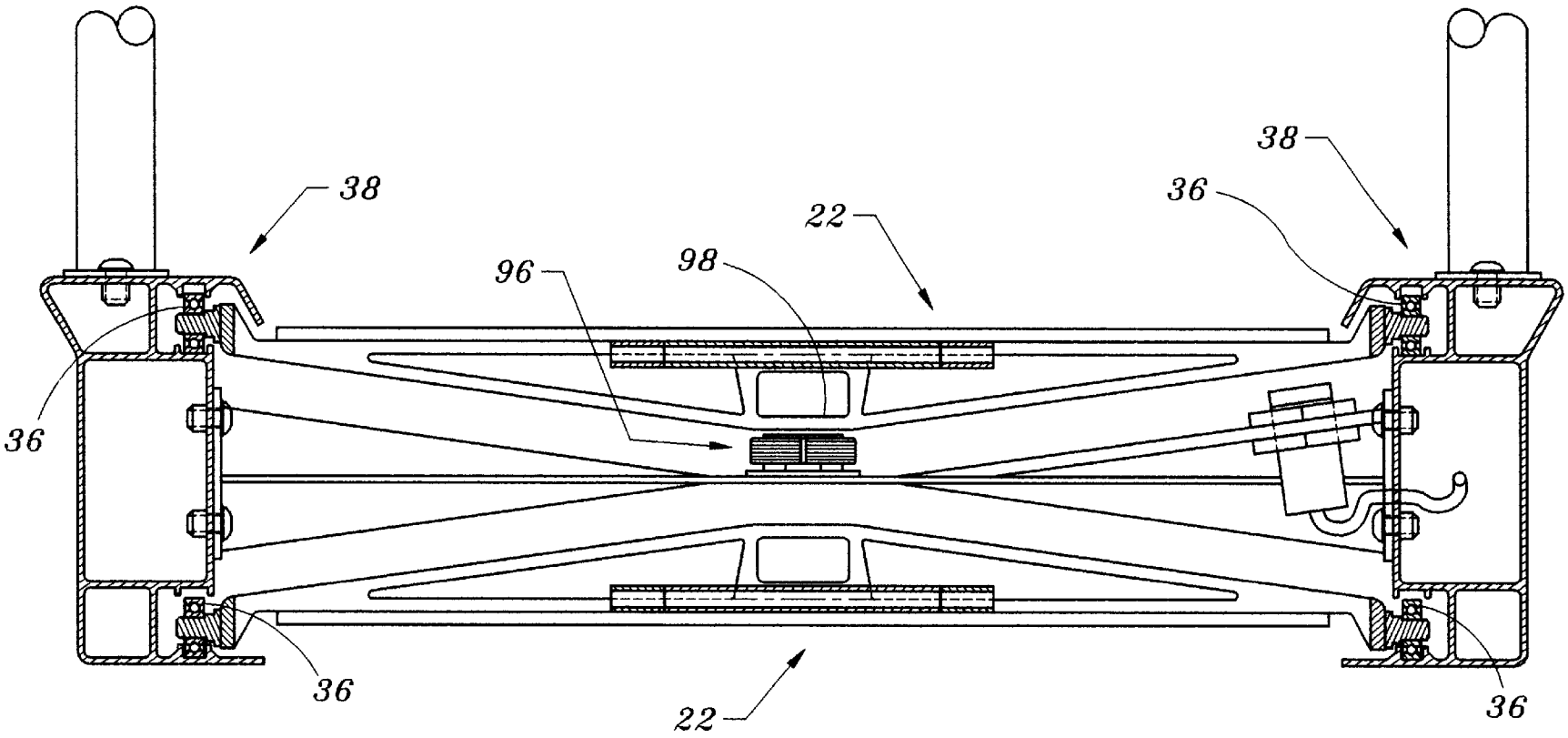
FIG. 10 is a side sectioned view along line 10—10 as shown in FIG. 1 showing an alternative coil arrangement comprising a transverse flux linear induction motor as a drive means for a moveable surface exercise device produced in accordance with an alternative to the preferred embodiment of the present invention.

An alternative drive means is disclosed in FIG. 10 which is a section along line 10—10 with the modification of the alternative drive. Similar deck members 22 are shown thereby forming an upper run and a lower run with support members 36 supporting and guiding the deck members 22 just as previously disclosed. Here the coils 96 are specific with the conductive plate portion 98 of the deck member 22 to produce a transverse flux linear induction motor. The plate portion 98 would be preferably be made of aluminum and the repulsive force generated by the coils would cause the aluminum plate portion 98 to float, thus further cushioning the running surface of the user. This would also decrease the load in the support members 36 and the stress in the deck members 22 because the load applied by a runner's feet is usually virtually always nearly centered on the deck member 22, directly above the coil 96.

The field is carried along the length of the frame to drive or slow the movement of the deck members 22. For such a design it may be necessary to increase the number of coils and therefore the groups of pods of coils may not be as preferable as one longitudinal string of coils spanning the length of the frame. In either case, the finction of the device remains unchanged. Disadvantages of the system are the necessity of three-phase power into the coils and potentially excessive shielding to protect the user from the potentially powerful electromagnetic field generated by the coils. Never the less, with the advent of technology in the area of high speed trains and the like, advances can soon make such a design very desirable.

Figure 11:
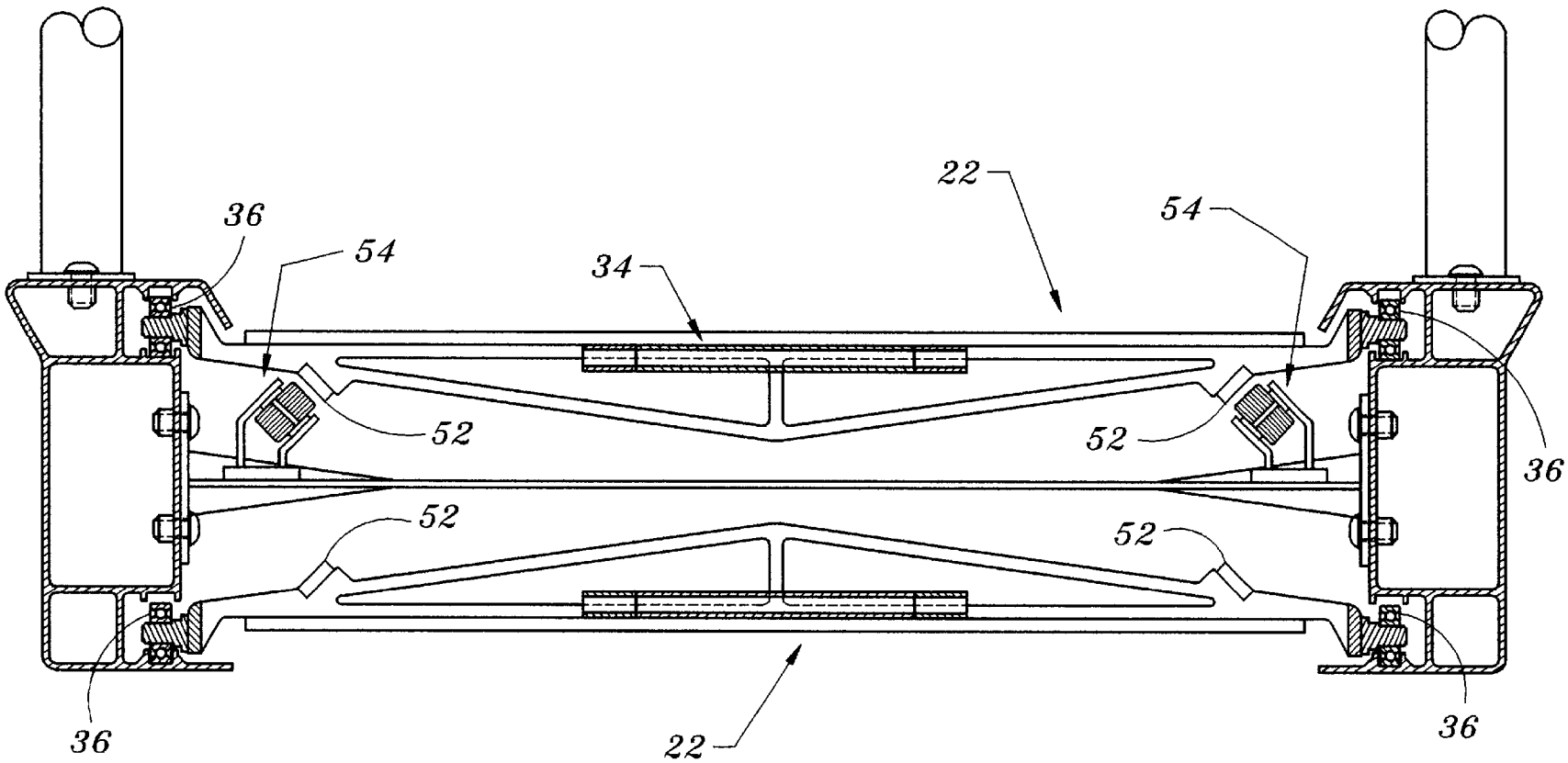
FIG. 11 is a side sectioned view consistent to that of FIG. 10, here showing another alternative coil and magnet arrangement for a moveable surface exercise device produced in accordance with an alternative to the preferred embodiment of the present invention.

Another variation to the drive means is disclosed in FIG. 11 which is also a section along line 10—10 with another alternative drive. Here the magnets 52 and coils 54 are located at the side of the deck members 22. This alteration puts the driving, or breaking, force near the support members 36 where the least bending stress is placed on the deck member 22 due to the loading from a user. This allows room for the greatest section modulus of the deck member 22 to be where the greatest stress is applied, in the center of the deck member 22. The angled orientation of the coils 54 and magnets 52 are to assist in the stabilization and tracking to the deck members 22 in the race. This angled design is not critical to the function of this alternative design. With this and the original design (FIG. 3), the coils are shown on top. The system could just as easily drive the continuous loop by driving the bottom run. The top run is considered preferable in that it is closer to the application of the load applied by the user, therefore the stress is transmitted between fewer deck members, thus minimizing wear on the pivot tubes 34.

It should also be noted that lift mechanisms to alter the inclination could easily be added to any design of this invention and are common place in the industry. The invention could also be placed at a small inclination at the lowest position and due to the minimal friction in the system, the user's body weight could run the deck members 22 through the coils and generate sufficient power to run the system. Additional braking resistance is dissipated as necessary in the form of heat above the 40–50 Watts needed to run the display and controller.

The disclosure has thus far been seemingly limited to induction and synchronous motors. Any suitable type of electromagnetic or magnetic machine is considered applicable to this application. Some others include AC polyphase commutator, single-phase AC commutator and repulsion motors, DC motors, even reluctance and hysteresis motors. These are especially important because with the minimal friction of the system, the motor is much of the time doing more braking than driving. The power supply to drive the display and controller of the unit can be in the form of a battery, thus eliminating the necessity for harnessing any of the power generated by the system. Either way, the benefit of eliminating the device from being tethered to an external power outlet is very valuable from a convenience factor, aside from the fact that external power must be modified to conform to the voltages and frequencies of different countries, adding to the cost of the device.

Figure 12:
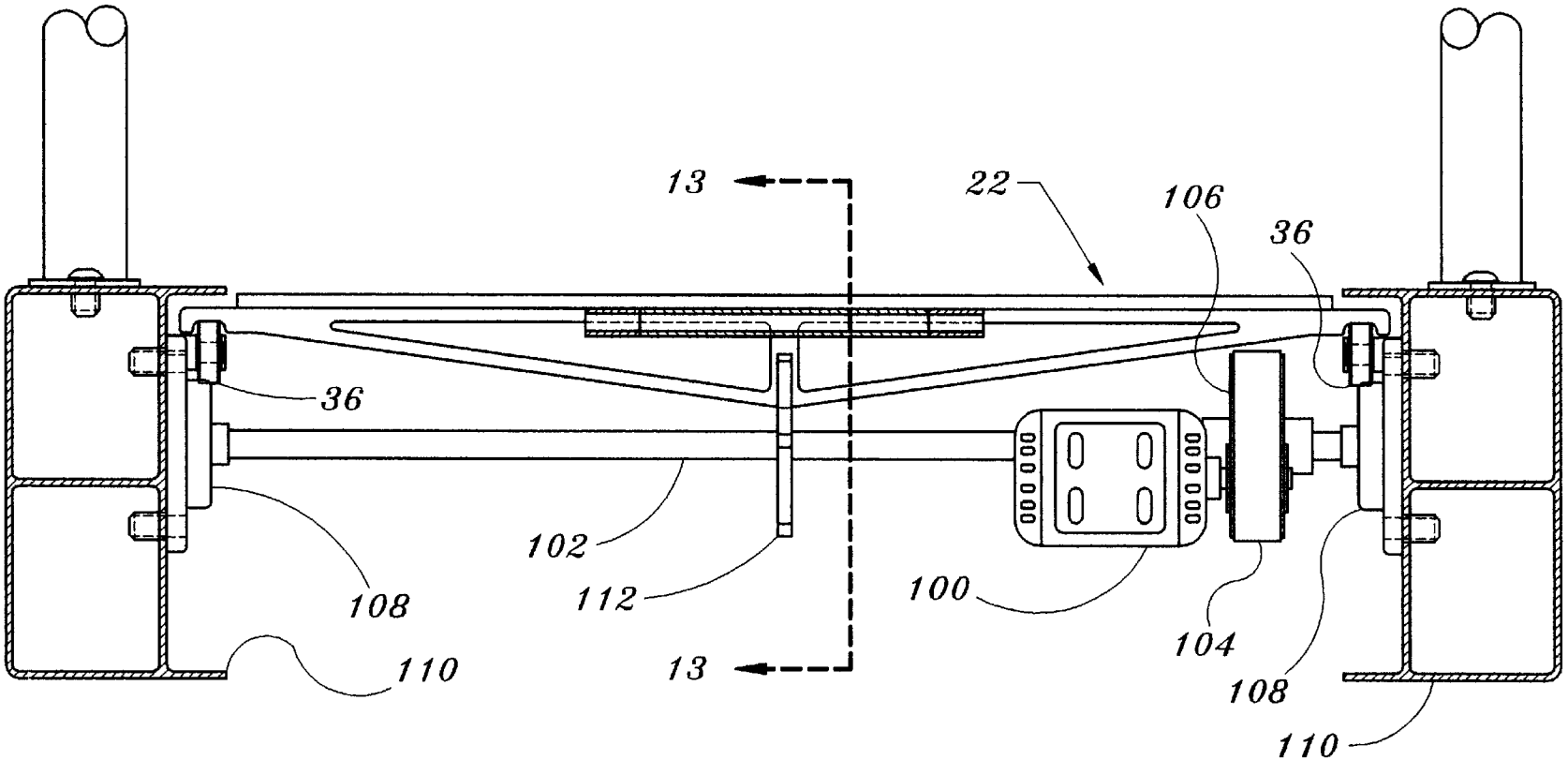
FIG. 12 is a partial side sectioned view consistent to that of FIG. 10, here showing a rotary motor drive with the lower deck members removed to more clearly show the function of a moveable surface exercise device produced in accordance with an alternative to the preferred embodiment of the present invention.

A rotary motor 100 is used in FIG. 12, which is also a representative section view along line 10—10 while allowing for the modification as disclosed. A single deck member 22 is shown to preserve the clarity of the invention, though upper and lower runs are also used in this alternative embodiment. The rotary motor 100 could be any form of rotary power production including an AC motor, a DC motor or a fluid power rotary actuator such as a pneumatic motor or a rotary hydraulic actuator. The rotary motor 100 drives a shaft 102 via a belt 104 that drives a belt pulley 106 that is attached to the shaft 102. The shaft 102 is adapted for rotary motion by the bearings 108 that locate the combination between the modified side frames 110. The shaft drives the star sprocket 112, which in turn directly drives the deck member 22. Here an alternative support system is used that could just as easily been used on any or all of the previous disclosures, in which the deck member 22 receives the support member 36 that is rotateably secured here to the modified side frame 110, rather than the support member 36 being rotatably secured to the deck member 22, as previously disclosed.

Figure 13:
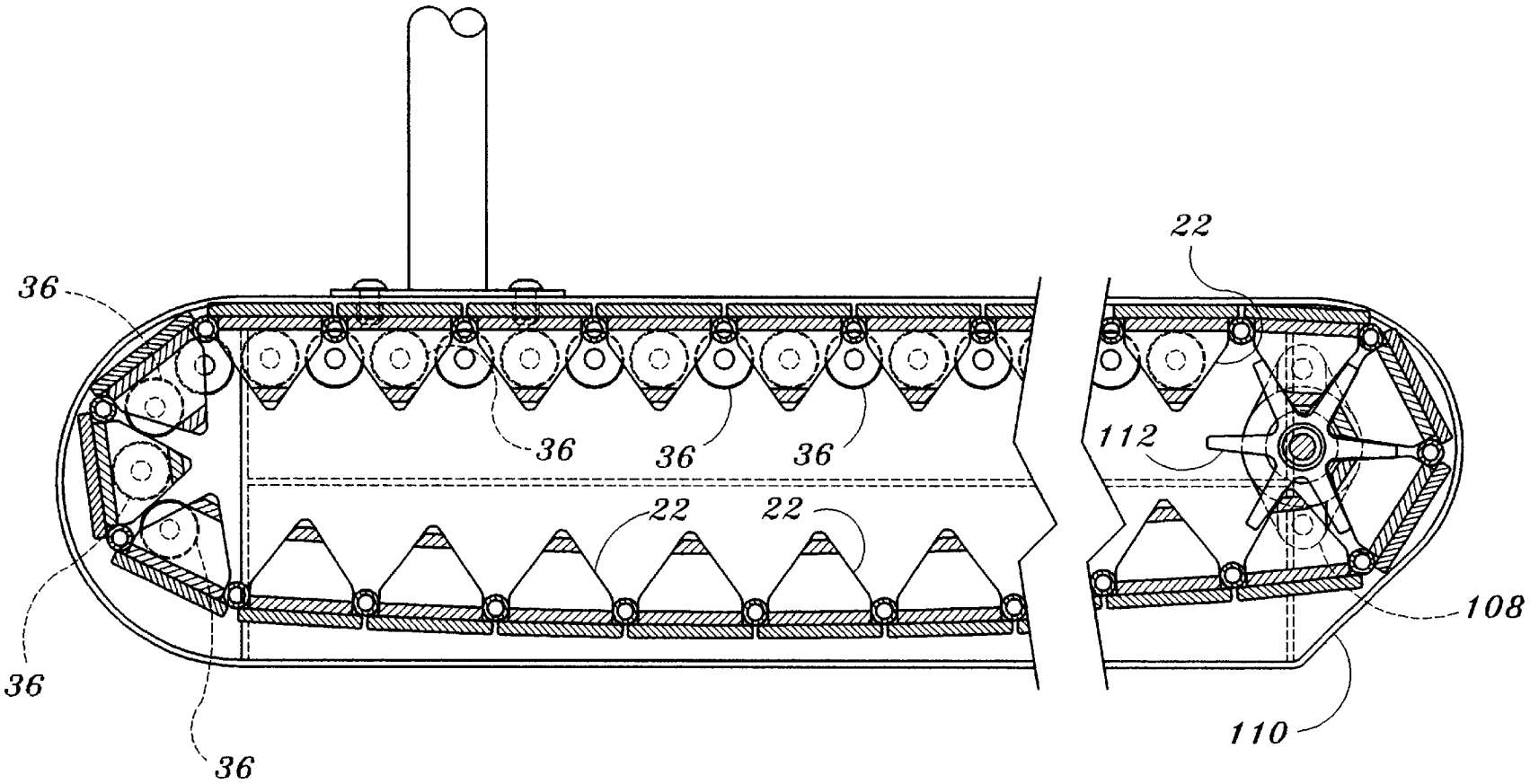
FIG. 13 is a partial front sectioned view along line 13—13 as shown in FIG. 12 of a complete moveable surface exercise device produced in accordance with an alternative to the preferred embodiment of the present invention.

A front sectioned view is shown in FIG. 13 along line 12—12, only representing the entire length of the invention as depicted in the sectioned view of FIG. 12. Here the star sprocket 112 is shown to articulate with the deck members 22 to drive same and the adjacently connected deck members 22 along the upper run. The upper run is supported by the adjacently positioned support members 36 being mounted to the frame. The front portion of the upper and lower runs includes a group of support members 36 arranged in an arcuate manner to provide the transition from the lower run to the upper run.

The star sprocket is shown here to be positioned at the rear portion of the upper and lower runs which not only drives the continuous loop created by the deck members 22 but provides the transition from the upper run to the lower run. This is the most convenient location for the sprocket 112 for that reason, but it is not necessary for the function of the invention. The star sprocket 112 could drive the upper or lower run at any position and an annular arrangement of support members 36 arranged similar to that shown on the front of the device, could also be used at the rear. The lower run could also be supported by support members but the weight of the sagging lower run provides tension to eliminate the need for a slack take up device. Since no load is placed on the lower run, this arrangement is the most cost efficient, and functional method of production of this version of the invention. A support member 36 or combination of support members can be used to apply force down on the lower run, thus acting as an idler to eliminate roughness at higher speeds.

The variations of support members rotateably mounted on the deck members or on the side frames, the use of linear or rotary motors or actuators and the use or lack of use of races for the lower runs of all of the disclosed are all considered part of this disclosure.

The possible combinations are many, yet a movable deck without the use of drum pulleys to drive the movable deck is both novel and useful. The elimination of sliding friction of a traditional deck and belt device to enhance the function, wear characteristics and the life of the product while also eliminating the costly drum pulleys, mechanism and associated frame support structure to drive a beltless conveyor system as disclosed herein, enables a cost efficient combination novel to the industry.

What is claimed is:

1. A moveable surface exercise device comprising:

a frame, including a pair of substantially longitudinal side frames;

a continuous segmented track, including:

a plurality of individual deck members movably connected one to another, thereby creating a continuous loop being disposed so as to enable an upper run and a lower run;

a plurality of support members mounted to said deck members, the support members being received by said frame;

a drive means mounted to said frame and capable of applying force to move said continuous loop along said frame; and a controller means to vary the force applied by said drive means, whereby said upper run is a continuous surface capable of moving and supporting a load placed on said deck members, the load being transmitted through said support members to said frame.

2. The exercise device as described in claim 1, wherein said support members are comprised of rolling elements.

3. The exercise device as described in claim 2, wherein said rolling elements are elements selected from the group consisting of ball bearings, roller bearings, cam followers and wheels.

4. The exercise device as described in claim 1, wherein said drive means is further comprised of a rotary power means and a coupling means, the rotary power means driving the coupling means which is in communication with said deck members, thus causing movement in same.

5. The exercise device as described in claim 4, wherein said rotary power means is a device selected from the group consisting of an alternating current electric motor, a direct current electric motor and a fluid power rotary actuator.

6. The exercise device as described in claim 1, wherein said drive means is further comprised of a linear motion power means and at least one sensing means capable of detecting the location of at least one deck member, the sensor in communication with said controller means, thereby enabling said linear motion power means to control the speed of motion of the deck members relative to said frame.

7. The exercise device as described in claim 6, wherein said linear motion power means is comprised of at least one coil means mounted to said frame, the at least one coil means capable of conducting an electric current and generating an electromagnetic field, thereby applying force to said deck members of said continuous loop.

8. A moveable surface exercise device comprising:

a frame including a pair of substantially longitudinal side frames, the side frames including an upper race and a lower race with arcuate end runs on the end of the side frames thereby connecting the upper race and the lower race of each side frame;

a continuous segmented track, including:

a plurality of individual deck members movably connected one to another, thereby creating a continuous loop;

a plurality of support members mounted to said deck members, support members being received by said upper race creating an upper run and support members being received by said lower race creating a lower run;

a drive means mounted to said frame and capable of applying force to move said continuous loop within said frame along said upper race and said lower race; and a controller means to vary the force applied by said drive means, whereby said upper run is a continuous surface capable of moving and supporting a load placed on said deck members, the load being transmitted through said support members to said frame.

9. The exercise device as described in claim 8, wherein said support members are comprised of rolling elements.

10. The exercise device as described in claim 9, wherein said rolling elements are elements selected from the group consisting of ball bearings, roller bearings, cam followers and wheels.

11. The exercise device as described in claim 8, wherein said drive means is further comprised of a rotary power means and a coupling means, the rotary power means driving the coupling means which is in communication with said deck members, thus causing movement in same.

12. The exercise device as described in claim 11, wherein said rotary power means is a device selected from the group consisting of an alternating current electric motor, a direct current electric motor and a fluid power rotary actuator.

13. The exercise device as described in claim 8, wherein said drive means is further comprised of a linear motion power means and at least one sensing means capable of detecting the location of at least one deck member, the sensor in communication with said controller means, thereby enabling said linear motion power means to control the speed of motion of the deck members relative to said frame.

14. The exercise device as described in claim 13, wherein said linear motion power means is comprised of at least one coil means mounted to said frame, the at least one coil means capable of conducting an electric current and generating an electromagnetic field, thereby applying force to said deck members of said continuous loop.

* * * * *